US006998767B2

(12) United States Patent
Saitou et al.

(10) Patent No.: US 6,998,767 B2
(45) Date of Patent: Feb. 14, 2006

(54) PROJECTION TUBE HAVING DIFFERENT NECK DIAMETERS

(75) Inventors: Kouichi Saitou, Chonan (JP); Kazumasa Hirai, Mobara (JP); Tetsuo Asano, Mobara (JP); Kotaro Aoki, Mobara (JP); Yasuo Tanaka, Ichihara (JP)

(73) Assignee: Hitachi Ltd., Tokyo (JP)

( * ) Notice: Subject to any disclaimer, the term of this patent is extended or adjusted under 35 U.S.C. 154(b) by 259 days.

(21) Appl. No.: 09/909,195

(22) Filed: Jul. 19, 2001

(65) Prior Publication Data

US 2002/0180335 A1 Dec. 5, 2002

(30) Foreign Application Priority Data

May 29, 2001 (JP) ..... 2001-159789

(51) Int. Cl.
*H01J 31/00* (2006.01)

(52) U.S. Cl. ..... 313/477 R

(58) Field of Classification Search ..... 313/477 R, 313/414, 418, 421, 441, 442
See application file for complete search history.

(56) References Cited

U.S. PATENT DOCUMENTS

| | | | | |
|---|---|---|---|---|
| 2,250,622 A | | 7/1941 | Bowie | |
| 3,163,794 A | | 12/1964 | Bloomsburgh | |
| 3,840,773 A | * | 10/1974 | Hart | 315/375 |
| 4,485,329 A | * | 11/1984 | Donofrio et al. | 313/478 |
| 5,777,430 A | | 7/1998 | Ueda et al. | |
| 5,909,079 A | * | 6/1999 | Uchida et al. | 313/414 |
| 5,994,830 A | * | 11/1999 | Nose et al. | 313/477 HC |
| 6,031,326 A | | 2/2000 | Suzuki et al. | |
| 6,133,685 A | * | 10/2000 | Konda et al. | 313/456 |
| 6,271,625 B1 | * | 8/2001 | Van Engelshoven et al. | 313/414 |
| 6,404,119 B1 | * | 6/2002 | Hidaka et al. | 313/477 R |
| 6,717,347 B1 | * | 4/2004 | Kubosaka et al. | 313/477 R |
| 6,750,602 B1 | * | 6/2004 | Hirota et al. | 313/477 R |
| 2003/0038583 A1 | * | 2/2003 | Suzuki et al. | 313/478 |
| 2004/0027043 A1 | * | 2/2004 | Saitou et al. | 313/364 |

* cited by examiner

*Primary Examiner*—Joseph Williams
*Assistant Examiner*—Peter Macchiarolo
(74) *Attorney, Agent, or Firm*—Milbank, Tweed, Hadley & McCloy LLP

(57) ABSTRACT

A projection tube having a high focusing performance at a low deflection power includes a funnel, a neck portion and a stem portion which seals the neck portion. The neck portion of the projection tube includes a first neck portion which is connected to the funnel and has a first neck outer diameter, and also includes a second neck portion which accommodates an electron gun and has a second neck outer diameter which is larger than the first neck outer diameter.

13 Claims, 5 Drawing Sheets

PROJECTION TUBE HAVING DIFFERENT NECK DIAMETERS

BACKGROUND OF THE INVENTION

1. Field of the Invention

The present invention relates to a projection tube which is used in a projection type TV receiver, a video projector or the like.

2. Description of the Related Art

An image may be created by scanning an electron beam emitted from an electron gun onto a cathode ray tube via a deflection yoke. The deflection yoke is mounted near a joint portion, which is located between a neck and a funnel. The deflection sensitivity of the deflection yoke is increased when the outer diameter of the neck is decreased. However, when the outer diameter of the neck is decreased in order to enhance the deflection sensitivity, the electron gun which is accommodated in the neck portion must be miniaturized correspondingly. When the electron gun is miniaturized, the diameter of an electron lens of the electron gun is decreased and hence, focusing is degraded. Therefore, it can be seen from the above description that increasing the deflection sensitivity by decreasing the outer diameter of the neck may result in decreased focusing performance.

A method which can solve such a problem is, for example, proposed in U.S. Pat. No. 3,163,794, which discloses a technique for enhancing the deflection sensitivity by making the outer diameter of a neck portion on which a deflection yoke is mounted smaller than the outer diameter of a neck portion in which an electron gun is accommodated. The maximum operating voltage of the cathode ray tube described in this patent is set to 16 kV.

On the other hand, with respect to a color cathode ray tube, Japanese Laid-open Patent Publication 185660/1999, discloses a technique for enhancing the deflection sensitivity by making the outer diameter of a portion of a neck on which a deflection yoke is mounted smaller than of a portion of the neck in which an electron gun is accommodated.

SUMMARY OF THE INVENTION

The cathode ray tube disclosed in the above-mentioned U.S. Pat. No. 3,163,794 has not yet been commercialized because the maximum operating voltage used is so low that any advantage obtained by the reduction of the deflection power is small. Further, since it is necessary to ensure a fixed dimension as the distance of the deflection yoke in the tube axis direction, when the outer diameter of a neck is set in two stages in an actual cathode ray tube, this causes an electron gun to be placed further from a phosphor screen due to mechanical restrictions. Accordingly, increasing the total length of the cathode ray tube gives rise to disadvantages such as the deterioration of focusing performance.

Further, the cathode ray tube which is disclosed in the abovementioned Japanese Laid-open Patent Publication 185660/1999 has also not yet been commercialized. That application discloses a color cathode ray tube having three electron beams which are arranged in an inline array. In such an arrangement, because the electron beams approach an inner wall of a neck tube at a narrowed neck portion at both sides, the electron beams may impinge on the inner wall of the neck tube when scanning. Accordingly, it is difficult to provide a decrease in diameter of the neck and hence, the deflection sensitivity enhancing effect becomes extremely small.

A typical object of the present invention is to provide a single electron beam type projection tube operable at a high voltage which can reduce the deflection power thus enhancing the focusing performance.

One aspect of the present invention includes a projection tube (PRT) which is operable at a high voltage of 25 kV or more, and which has a single electron beam and a large current. In this aspect of the present invention, the outer diameter of a neck portion on which a deflection yoke is mounted is smaller than the outer diameter of the neck portion which accommodates an electron gun.

In this aspect of the present invention, deflection power may be reduced and focusing performance may be enhanced.

In the PRT of the present invention, the reduction in the amount of deflection power is remarkably large compared to a usual cathode ray tube. This is true for the following three reasons: first, the cathode ray tube of the present invention is operated at a high voltage; second, in the present invention, two to three times more scanning lines may be used compared to a usual TV set; and third, the present invention uses three PRTs in a projection type TV receiver.

Further, in the PRT, the improvement of the spherical aberration which occurs when the diameter of an electron lens is enlarged is more important than the improvement of the deterioration of focusing which occurs by the expansion of electron beams derived from the repulsion of the electron beams. That is, in the PRT, the effect of enlarging the diameter of the lens of the electron gun is more important than the effect of moving the electron gun farther from a phosphor screen by changing the neck diameter.

Accordingly, the advantages of the present invention are extremely large.

In another aspect of the present invention, the outer diameter of the neck where the deflection yoke is mounted is set to a value equal to or less than 29.1 mm, the outer diameter of neck where the electron gun is accommodated is set to a value more than 29.1 mm, and the diameter of a pin circle arrangement at a stem portion which supplies a voltage to the electron gun is set to a value equal to the case of the neck outer diameter of 29.1 mm.

Due to such arrangement, a deflection circuit system can use a standard circuit for a neck of 29.1 mm and the focusing performance can be enhanced.

DESCRIPTION OF THE PREFERRED EMBODIMENTS

An embodiment of a projection tube having different neck diameters according to the present invention is explained hereinafter in conjunction with attached drawings.

Figure 1:
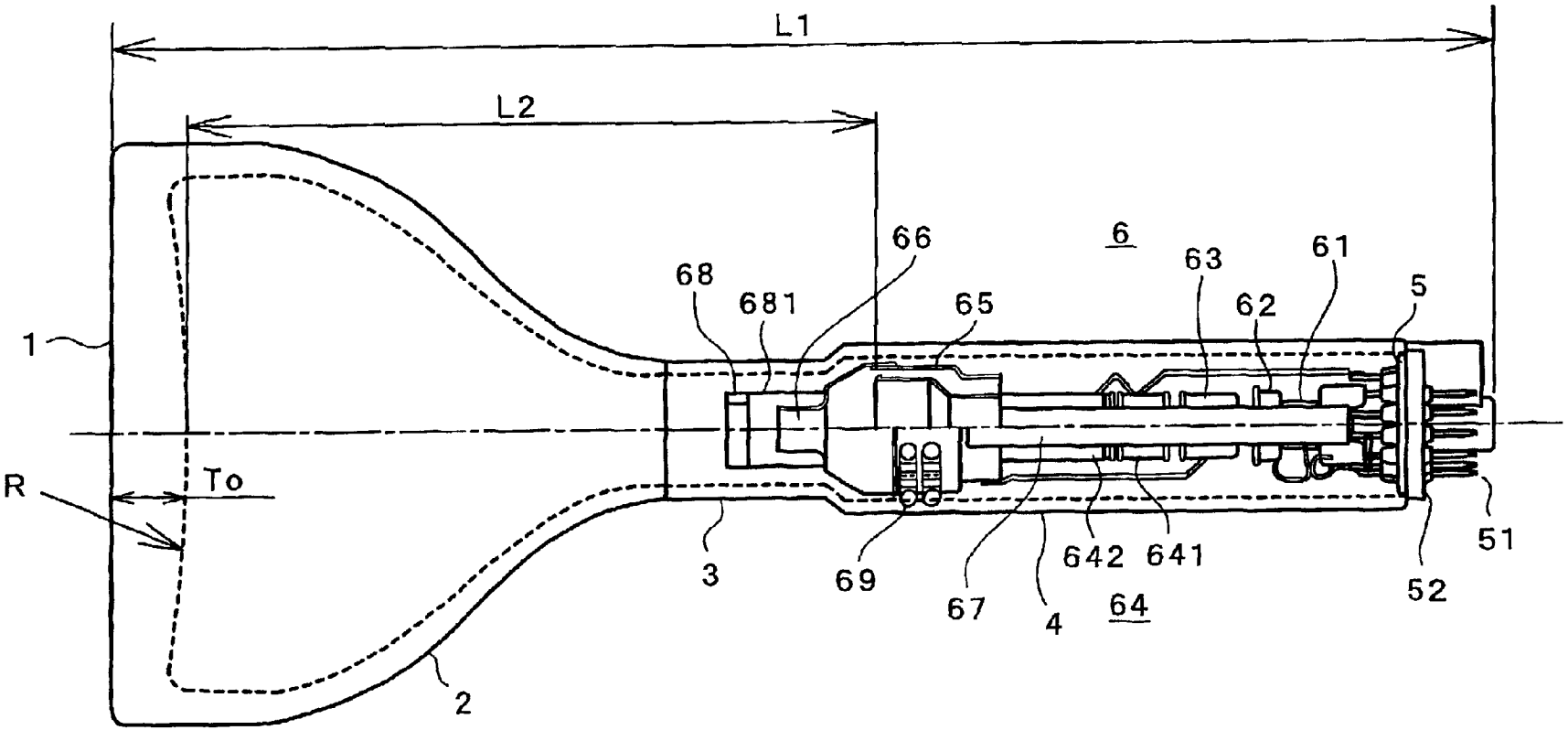
FIG. 1 is a schematic cross-sectional view of a cathode ray tube for a projection type TV receiver (PRT) of the present invention.

FIG. 1 is a schematic cross-sectional view of a cathode ray tube for a projection type TV receiver (PRT) of the present invention. When a monochromatic image is formed in the PRT only one electron beam is used. A panel 1 has a flat outer surface and an inner surface which is bulged toward an electron gun side forming a convex lens. In this embodiment, the inner surface of the panel 1 is formed in a spherical face having a radius R of curvature of 350 mm. To reduce the aberration, the inner surface may be formed in a non-spherical face. The thickness To of the panel 1 at the center thereof is 14.1 mm. The profile size of the panel 1 in the diagonal direction is set to 7 inches and the effective diagonal diameter which allows the formation of image is set to 5.5 inches. The total length L1 of the PRT is set to 276 mm. A funnel 2 connects a neck portion 3 and the panel 1.

The outer diameter of the neck portion 3 is set to 29.1 mm. The outer diameter of a neck portion 4 which accommodates the electron gun is set larger than the outer diameter of the neck portion 3 and is set to 36.5 mm. Here, 29.1 mm and 36.5 mm which indicate the neck outer diameters mean substantial numerical values which are set in consideration of errors in manufacturing necks. A deflection yoke which deflects an electron beam is mounted on the neck portion 3 which has the small diameter. Due to such an arrangement, the deflection power can be suppressed as small a value as possible. In this case, when the outer diameter of neck portion 3 is set to 29.1 mm, the deflection power can be reduced by approximately 25% compared with a case in which the outer diameter of neck portion 3 is set to 36.5 mm.

Since an electron gun 6 is accommodated in the neck portion 4 which has the large diameter, the diameter of an electron lens can be made large. A first grid 61 of the electron gun 6 has a cup-like shape and a cathode which emits the electron beam is accommodated in the first grid 61. An accelerating electrode 62 forms a prefocus lens together with the first grid electrode 61. An anode voltage of 30 kV which is a voltage applied to a second anode electrode 65 which constitutes a final electrode is also applied to a first anode 63. In general, the anode voltage applied to the PRT is equal to or more than 25 kV.

By making the neck outer diameters different, the electron gun 6 is positioned further from a phosphor surface due to mechanical restrictions and as a result, focusing is deteriorated. However, in the PRT of the present invention, because the voltage is set to such a high level, the PRT can easily cope with the focusing problem. The PRT can be operated at the maximum voltage of equal to or more than 30 kV.

A focus electrode 64 is divided into a focus electrode 641 and a focus electrode 642, wherein a focus voltage of approximately 8 kV is applied to both focus electrodes 641, 642. The distance L2 between a distal end of the focus electrode 642 and the inner surface of the panel 1 is set to 139.7 mm. The focus electrode 642 enlarges the diameter thereof at the phosphor screen side thereof and forms a large diameter main lens together with the second anode 65. This main lens can be made larger corresponding to the increase of the neck outer diameter.

Since the PRT requires a high brightness, a beam current (a cathode current) may be set equal to or more than 4 mA. To ensure high focusing performance even with such a large current, it is extremely important that the diameter of the main lens can be increased. In the PRT, since the voltage on the phosphor screen is high, the expansion of the beam derived from the repulsion of space charge particularly at the time of supplying a large current becomes relatively small and the size of the electron beam spot on the phosphor screen at the time of supplying a large current is substantially determined by the expansion of the beam due to the spherical aberration of the electron gun.

A shield cup 66 integrally forms a main lens together with the second anode 65. The diameter of the phosphor screen side of the shield cup 66 is gradually made small. Corresponding to the arrangement in which the neck outer diameter becomes small in the vicinity of the distal end of the electron gun, the diameter of the electron gun in the vicinity of the distal end thereof is also made small thus preventing the electron gun from being positioned far from the phosphor screen.

Respective electrodes are fixedly secured by a bead glass 67. The phosphor screen side of the shield cup 66 has the outer diameter thereof made considerably smaller than that of the second anode 65. This provision is provided to prevent the deterioration of the withstand voltage which is caused by the adhesion of getter for enhancing the degree of vacuum in the inside of the PRT to the electrode. A ring-shaped getter 68 is connected to the shield cup 66 by means of a getter support 681.

A bulb spacer contact 69 assures a proper distance between an inner wall of the neck portion and the electron gun. Although the bulb spacer contact 69 is provided at a position which corresponds to the outer diameter of the neck which is 36.5 mm in FIG. 1, the bulb spacer contact 69 may be provided at a position which corresponds to the outer diameter of the neck which is 29.1 mm.

Figure 2:
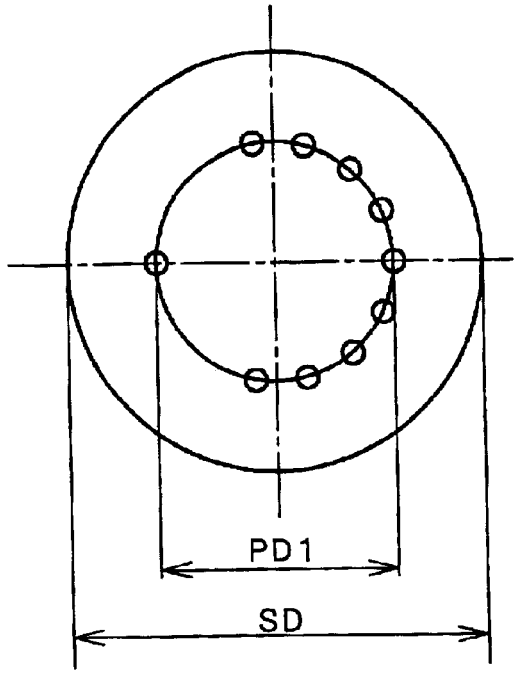
FIG. 2 is a plan view showing a stem portion of the PRT of the present invention.

The stem 5 is provided with pins 51 for supplying voltages to respective electrodes of the electron gun. A base 52 protects this stem 5 and the pins 51. FIG. 2 is a plan view of the stem portion according to this embodiment. The outer diameter of the stem SD is set to 28.3 mm and corresponds to the outer diameter of the neck which is 36.5 mm. The feature of this embodiment lies in that although the outer diameter of the stem corresponds to the outer diameter of the neck which is 36.5 mm, the diameter of the pin circle PD1 is set to 15.12 mm which is the diameter corresponding to the outer diameter of the neck which is 29.1 mm. Here, 15.12 mm is a substantial value which is set taking the manufacturing error into consideration.

Figure 3:
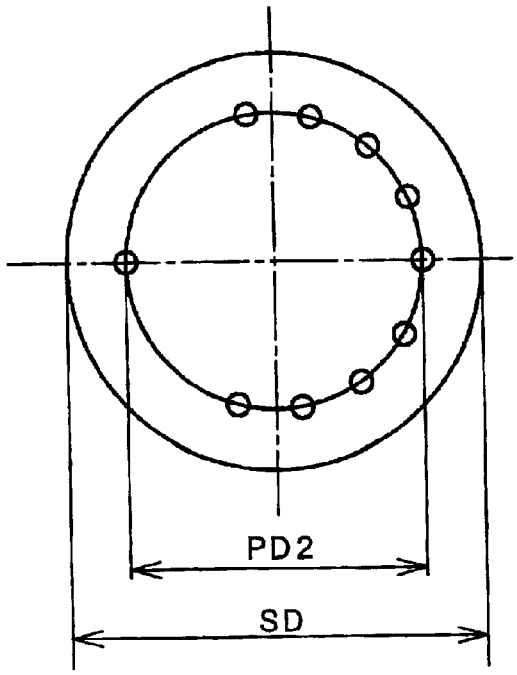
FIG. 3 is a plan view showing a stem portion in case of a usual 36.5 mm neck.

For a comparison purpose, a plan view of a usual stem portion when the outer diameter of the neck is set to 36.5 mm is shown in FIG. 3. The outer diameter of the stem SD is set to 28.3 mm and the diameter of the pin circle PD2 is set to 20.32 mm. It is a usual design to increase the pin circle corresponding to the increase of the outer diameter of the neck, because as the pin circle becomes larger, the distance between respective pins becomes larger and hence, it is advantageous for the withstand voltage.

However, in this embodiment of the present invention, the outer diameter of the neck is set to 36.5 mm and the diameter of the pin circle is set equal to the diameter of the pin circle when the neck outer diameter is set to 29.1 mm in order to interface with a portion of a deflection circuit which connects to the pins 51. Since a deflection yoke which corresponds to the neck outer diameter of 29.1 mm is used, by setting the diameter of the pin circle to a value which is equal to the diameter of the pin circle when the neck outer diameter is set to 29.1 mm, a circuit board which is equal to a circuit board when the neck outer diameter is 29.1 mm can be used. Further, a commonly found connector for the neck outer diameter of 29.1 mm can be used.

Figure 4:
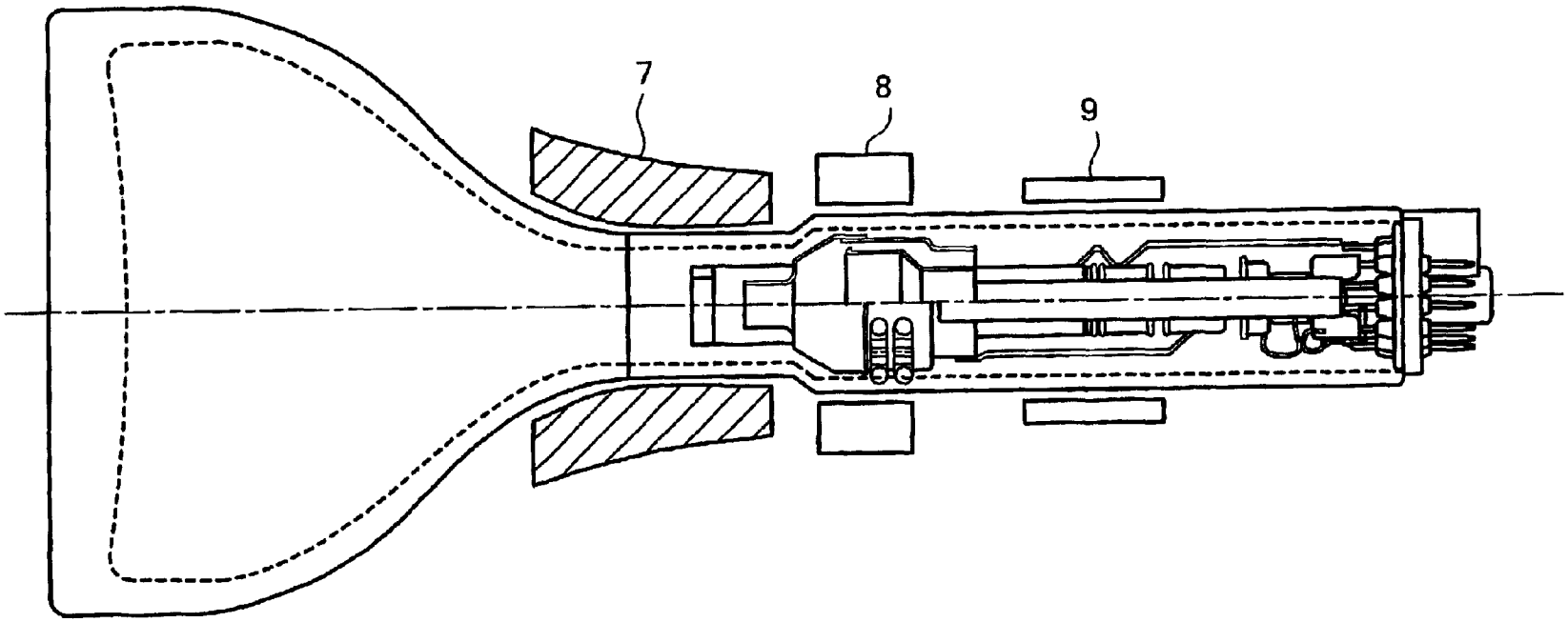
FIG. 4 is a schematic view showing an arrangement in which a deflection yoke, a convergence yoke and a velocity modulation coil are mounted on the PRT in one aspect of the present invention.

FIG. 4 is a schematic view showing an arrangement according to one aspect of the present invention in which a deflection yoke 7, a convergence yoke 8 and a velocity modulation coil 9 are mounted on the PRT of the present invention. The deflection yoke 7 is mounted on the neck portion 3 having the small diameter. The convergence yoke 8 is mounted on the neck portion 4 having the large diameter. The reason that the convergence yoke 8 is mounted on the neck portion 4 having the large diameter lies in the prevention of the excessive elongation of the total length of the PRT.

By allowing the total length of the PRT to be elongated and mounting the convergence yoke 8 on the neck portion 3 having the small diameter, the sensitivity of the convergence yoke 8 can be enhanced. Further, the integration of the deflection yoke 7 and the convergence yoke 8 can be facilitated.

Figure 5:
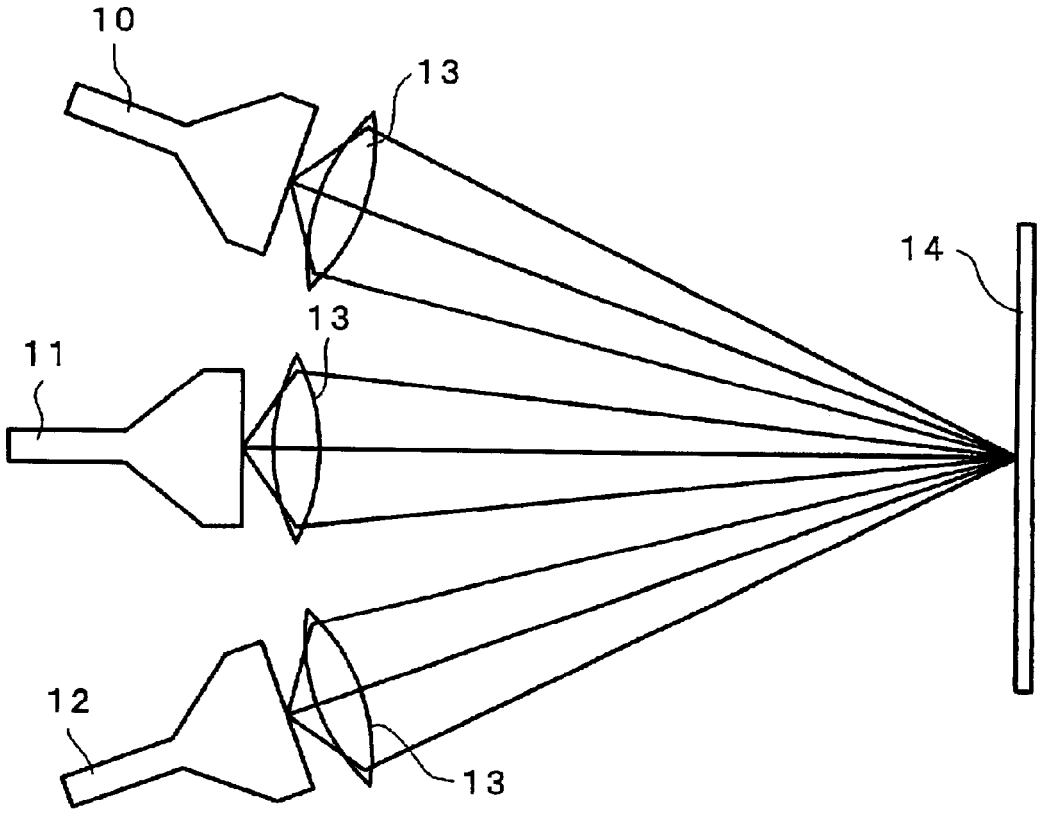
FIG. 5 is a conceptual view of a projection type TV receiver in a planar arrangement in one aspect of the present invention.

As shown in FIG. 5, in a projection type TV receiver, images projected from three PRTs including a red PRT 10, a green PRT 11 and a blue PRT 12 are converged on a screen 14 after passing through lenses 13 so as to form a projected image. Although the convergence is performed by inclining respective PRTs relative to each other, the fine adjustment is performed by the convergence yokes 8 mounted on the respective PRTs.

The velocity modulation coil 9 enhances the contrast of the image. When the velocity modulation coil 9 is mounted on the portion having the neck outer diameter of 36.5 mm, the sensitivity becomes a problem. For enhancing the sensitivity of the velocity modulation coil 9, the focus electrode 64 is divided into the electrode 641 and the electrode 642 and a gap is formed between the electrode 641 and the electrode 642 so as to facilitate the application of the magnetic field of the velocity modulation coil 9 to the electron beams.

Figure 6:
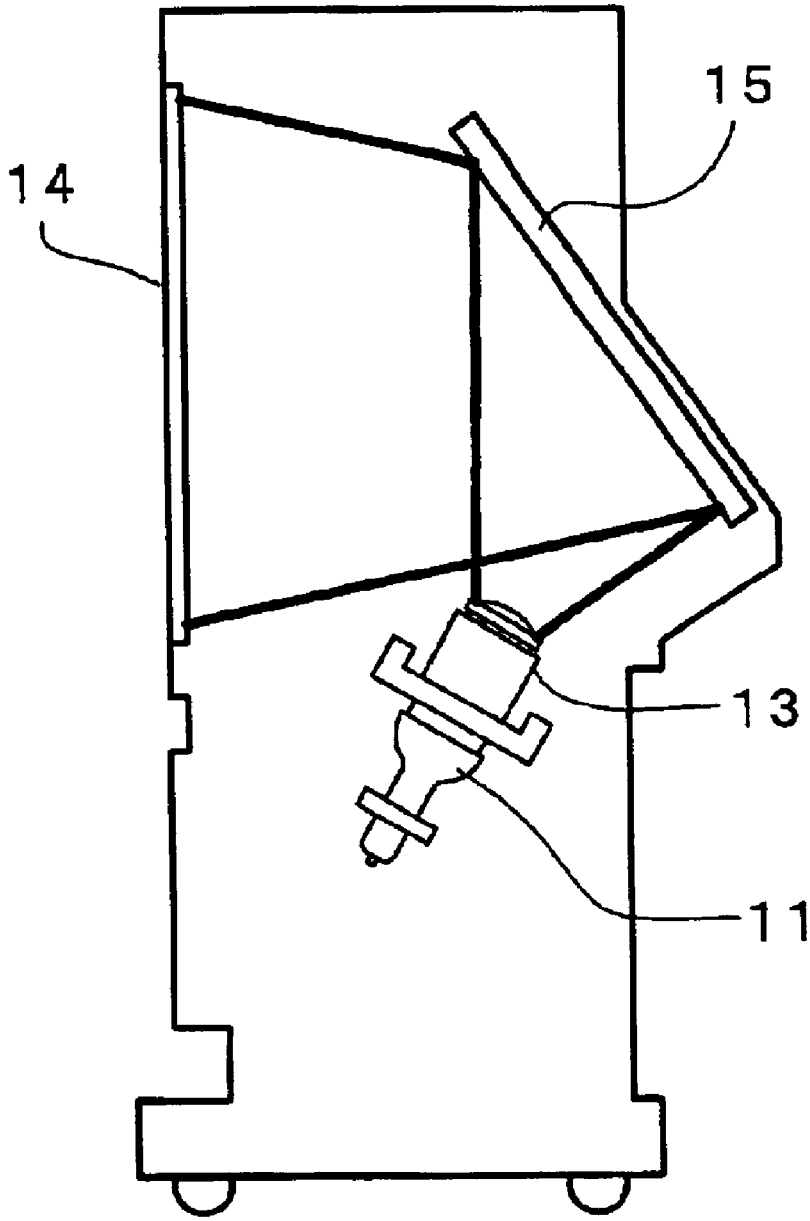
FIG. 6 is schematic longitudinal cross-sectional view of the projection type TV receiver.

FIG. 6 is a schematic cross-sectional view of the projection type TV receiver. The image projected from the PRT 11 passes through the lens 13, is reflected on a mirror 15 and then is projected onto the screen 14. As shown in FIG. 6, the total length of the PRT does not directly influence the depth of the projection type TV receiver.

Further, since the projection type TV receiver uses three PRTs, with respect to the overall deflection power savings, the projection type TV receiver exhibits deflection power savings which are three times higher than that of a usual TV set. Further, the projection type TV receiver usually has a large screen diagonal size of at least 40 inches. In such a large screen, scanning lines become apparent thus deteriorating the image quality when usual NTSC signals are used. To prevent this phenomenon, in the projection type TV receiver, the ADVANCED TV method which has a large number of scanning lines is adopted in many cases. In this case, the number of scanning lines becomes two to three times larger than that of the usual NTSC method so that the deflection power is increased. Accordingly, with the use of the PRT according to the present invention, an extremely large deflection power saving effect can be obtained in the projection type TV receiver.

The present invention is applicable not only to the projection type TV receiver but also to a general projector which uses three PRTS.

As has been described heretofore, according to an arrangement of one aspect of the present invention, the deflection power of the projection tube can be reduced and the focusing performance can be enhanced.

What is claimed is:

1. A projection tube comprising a panel which forms a phosphor screen on an inner surface thereof, a funnel, a neck portion and a stem portion which seals the neck portion, wherein the neck portion includes a first neck portion which constitutes a portion connected to the funnel portion and has a first outer diameter of the neck portion, and a second neck portion which constitutes a portion which accommodates an electron gun having a focus electrode and an anode electrode and has a second outer diameter of the neck portion, the first outer diameter of the neck portion is set smaller than the second outer diameter of the neck portion, the electron gun emits a single electron beam to the phosphor screen, the focus electrode and the anode electrode are disposed within the second neck portion, and a maximum operating voltage of the electron gun is set to equal to or more than 25 kV.

2. A projection tube according to claim 1, wherein the maximum operating voltage is set to equal to more than 30 kV.

3. A projection tube according to claim 1, wherein the maximum cathode current is set to equal to or more than 4 mA.

4. A projection tube according to claim 1, wherein the first outer diameter of the neck portion is set to equal to or less than 29.1 mm.

5. A projection tube according to any one of preceding claims 1 and 4, wherein the second outer diameter of the neck portion is set to equal to or more than 36.5 mm.

6. A projection tube according to claim 1, wherein the first outer diameter of the neck portion is set to 29.1 mm and the second outer diameter of the neck portion is set to 36.5 mm.

7. A projection tube according to claim 5, wherein the stem portion includes a plurality of pins for supplying voltages to electrodes of the electron gun and the plurality of pins are arranged in a circle having the diameter of 15.12 mm.

8. A projection tube comprising a panel which forms a phosphor screen on an inner surface thereof, a funnel, a neck portion and a stem portion which seals the neck portion, wherein the neck portion includes a first neck portion which constitutes a portion connected to the funnel portion and has a first outer diameter of the neck portion, and a second neck portion which constitutes a portion which accommodates an electron gun having a focus electrode and an anode electrode and has a second outer diameter of the neck portion, the first outer diameter of the neck portion is set smaller than the second outer diameter of the neck portion, the electron gun emits a single electron beam to the phosphor screen, a maximum operating voltage of the electron gun is set to equal to or more than 25 kV, and a deflection yoke which deflects the electron beam is mounted on the first neck portion having the first neck outer diameter.

9. A projection tube according to claim 8, wherein the projection tube includes a convergence yoke which adjusts the convergence when the projection tube is incorporated into a projector, and the convergence yoke is mounted on the second neck portion having the second outer diameter of the neck portion.

10. A projection tube according to claim 8, wherein the first outer diameter of the neck portion is set to equal to or less than 29.1 mm.

11. A projection tube according to any one of claim 8 and claim 10, wherein the second outer diameter of the neck portion is set to equal to or more than 36.5 mm.

12. A projection tube according to claim 11, wherein the stem portion includes a plurality of pins for supplying voltages to electrodes of the electron gun and a plurality of said pins are arranged in a circle having the diameter of 15.12 mm.

13. A projection tube according to claim 8, wherein the first outer diameter of the neck portion is set to 29.1 mm and the second outer diameter of the neck portion is set to 36.5 mm.

* * * * *